United States Patent [19]

Booth, Sr.

[11] Patent Number: 4,497,569

[45] Date of Patent: Feb. 5, 1985

[54] COPY PROCESSING SYSTEM FOR A REPRODUCTION MACHINE

[75] Inventor: Ronald P. Booth, Sr., Pittsford, N.Y.

[73] Assignee: Xerox Corporation, Stamford, Conn.

[21] Appl. No.: 421,005

[22] Filed: Sep. 21, 1982

[51] Int. Cl.[3] ..... G03G 15/00

[52] U.S. Cl. ..... 355/14 R; 355/14 C; 355/14 SH

[58] Field of Search ..... 355/14 SH, 14 C, 14 R, 355/3 SH; 371/15, 20, 62; 271/259, 258; 340/675

[56] References Cited

U.S. PATENT DOCUMENTS

| | | | |
|---|---|---|---|
| 3,878,540 | 4/1975 | Kawai | 355/14 R X |
| 4,109,574 | 8/1978 | Förster et al. | 101/216 |
| 4,110,032 | 8/1978 | Hubbard et al. | 355/14 SH X |
| 4,156,133 | 5/1979 | Legg | 235/92 SB |
| 4,206,995 | 6/1980 | Legg | 355/14 C |
| 4,283,773 | 8/1981 | Daughton et al. | 364/900 |
| 4,338,671 | 7/1982 | Korytkowski et al. | 271/259 X |

OTHER PUBLICATIONS

*IBM Technical Disclosure Bulletin,* vol. 21, No. 9, Feb. 1979, Travis, T., "Jam Indication".

*Primary Examiner*—A. T. Grimley
*Assistant Examiner*—J. Pendegrass
*Attorney, Agent, or Firm*—Frederick E. McMullen

[57] ABSTRACT

A xerographic type reproduction machine or copier having means to monitor movement of the copy sheet and control processing thereof as the copy sheet moves along the machine paper path. A series of copy sheet monitoring stations at discrete intervals along the paper path and a copy information byte, which is provided with each copy sheet and which has instructions for processing the copy sheet to the next monitoring station, are provided. At start-up and during processing as the copy sheet moves from one station to the next, successive jam checks are made to identify and monitor movement of the copy sheet along the paper path. As each jam check is satisfied, the copy information byte is moved from one reading location to another to provide instructions for processing the copy sheet in the interval to the next monitoring station.

Where a jam occurs in the relatively difficult to access paper tray area of the machine, the paper tray feeder and copy sheet transport means are operated temporarily despite the jam in an attempt to move any jammed sheet to a more favorable position for clearing the jam.

10 Claims, 9 Drawing Figures

FIG. 3
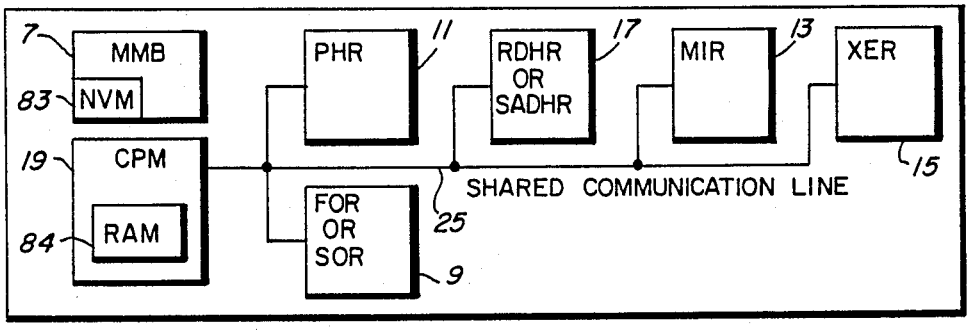
FIG. 4
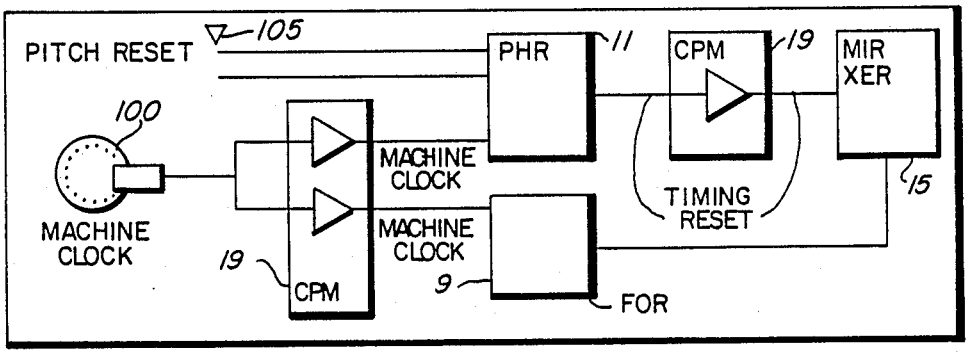
FIG. 5
89 COPY INFORMATION BYTE
| FEED / NO FEED | PURGE | ENDSET | INVERT | DESTINATION | | SOURCE | |
|---|---|---|---|---|---|---|---|
| X | X | X | X | X | X | X | X |

COPY PROCESSING SYSTEM FOR A REPRODUCTION MACHINE

This invention relates to a reproduction machine or copier, and more particularly to an improved copy processing system for a reproduction machine or copier.

In an effort to enhance copy throughput and reduce cost, present day reproduction machines process copies at a relatively high speeds. Additionally, to provide all of the various features demanded by users such as duplexing, the path followed by the copy sheets has increased in length and complexity with numerous gates and secondary path options added to the copy path. As a result, the severity and sometimes the incidence of copy sheet jams has become more pronounced. This is coupled with the difficulty of accessing the jammed area or areas to clear out any damaged or destroyed copies prior to returning the machine to full productivity and offtimes with the difficulty in simply finding all the copy sheets left in the paper path.

With regard to the latter, the increasing number of components required to provide the operator or user with the features he desires, together with the desirability of reducing overall machine size and emphasis on compact machines, has increased internal machine congestion. This has in turn increased the difficulty of accessing various areas of the machine to clear any jammed copies and has usually resulted in longer machine down times as the operator goes through the sometimes slow and painstaking process of removing copy sheets along the entire paper path to assure that all possible jammed copies have been removed.

The invention relates to a reproduction machine, comprising in combination: means forming a paper path long which a copy sheet being processed passes; transport means for moving the copy sheet along the path, a plurality of discrete copy sheet monitoring stations disposed at preset locations along the path for monitoring movement of the copy sheet along the path from station to station; and control means for enabling the monitoring stations whereby each monitoring station scans the path for the copy sheet, the next one of each monitoring station; the next one of each of the monitoring stations commencing tolling of a predetermined timed interval in response to detection of the copy sheet by the preceding monitoring station for the copy sheet to reach the next succeeding monitoring station whereby movement of each copy sheet along the path is monitored.

The invention further relates to a method for operating a reproduction machine to produce copies, the machine having a paper path along which the copy sheets move while producing copies, transport means for moving copy sheets along the path, and a plurality of copy sheet monitoring stations at predetermined locations along the paper path; comprising the steps of: scanning for a copy sheet at each of the stations; on detecting a copy sheet at one of the stations, initiating a jam check providing a predetermined timed interval within which the sheet must reach the next station; and either clearing the jam check in response to detection of the sheet at the next station within the predetermined timed interval or generating a fault in response to failure of the sheet to reach the next station within the timed interval.

IN THE DRAWINGS

FIG. 3 is a schematic view illustrating the control subdivisions and communication channel for the reproduction machine shown in FIG. 1;

FIG. 4 is a schematic view illustrating the distribution of timing signals to the various control subdivisions for the machine shown in FIG. 1;

FIG. 5 is a view showing details of the information byte accompanying each copy and bearing instructions for processing the copy;

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
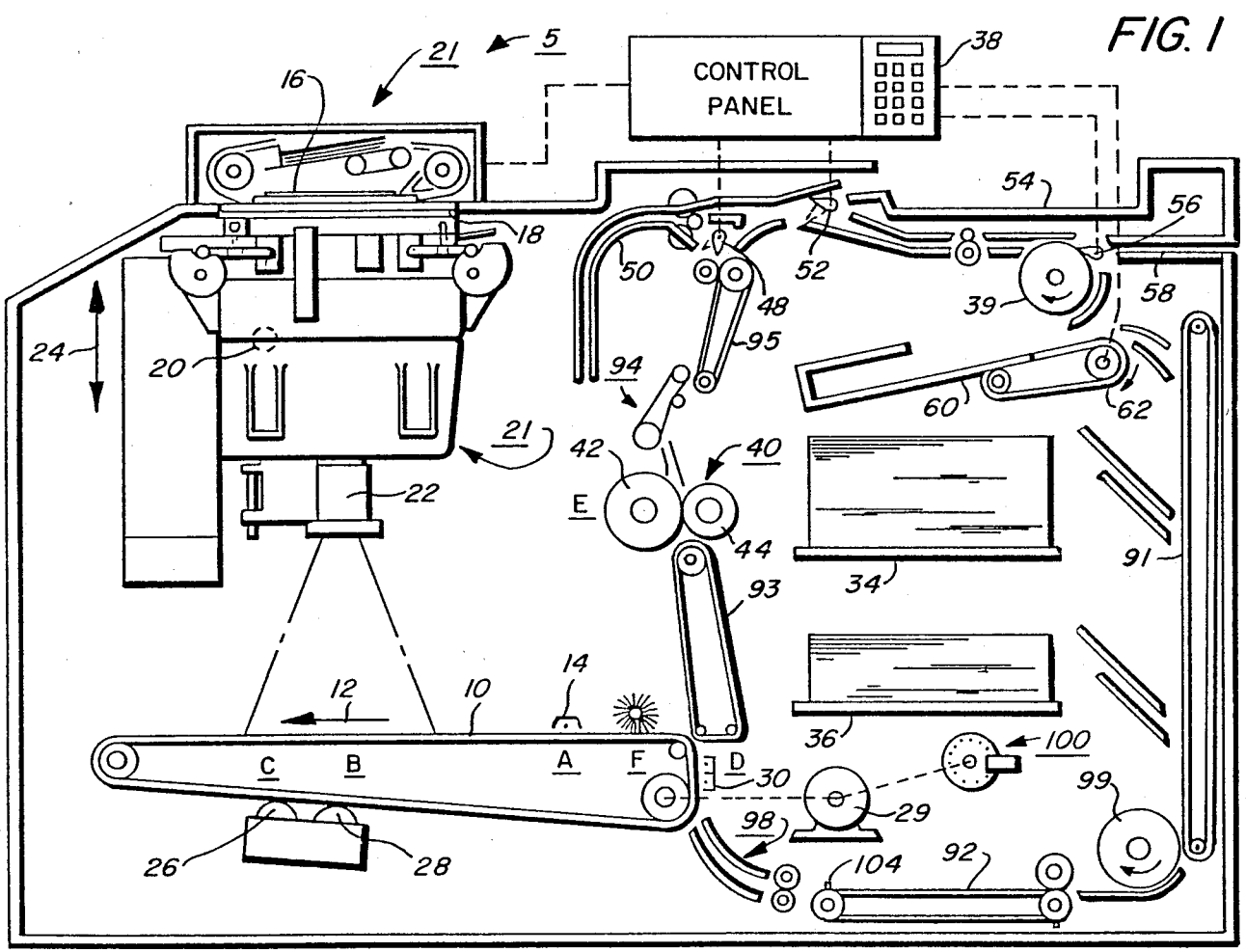
FIG. 1 is a plan view of a reproduction machine incorporating the copy sheet processing system of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine 5 incorporating the copy processing and jam monitoring system of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the printing machine 5 will be shown hereinafter schematically and their operation described briefly with reference thereto.

Figure 2:
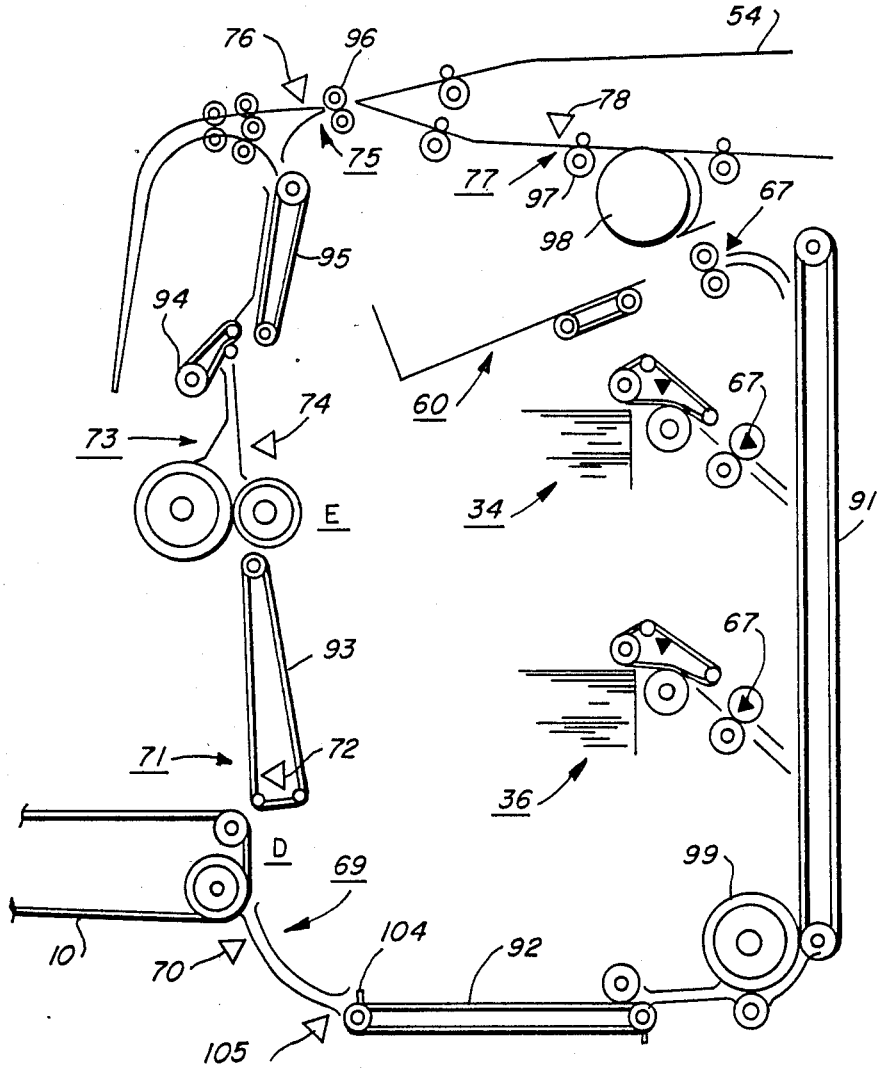
FIG. 2 is a schematic illustration showing details of the reproduction machine paper path and jam detection stations.

As shown in FIGS. 1 and 2, the illustrative electrophotographic printing machine 5 employs a belt 10 having a photoconductive surface thereon. Preferably, the photoconductive surface is made from a selenium alloy. Belt 10 is driven by main drive motor 29 and moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 21, positions original documents 16 facedown over exposure system 23. The exposure system, indicated generally by reference numeral 23 includes lamp 20 which illuminates the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 21 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured. Preferably, magnification of the imaging system is adjusted to insure that the indicia or information contained on the original document is reproduced within the space of the copy sheet.

While a document handling unit has been described, one skilled in the art will appreciate that the original document may be manually placed on the platen rather than by the document handling unit. This is required for a printing machine which does not include a document handling unit.

A plurality of sheet transports comprising a vertical transport 91, a registration transport 92, prefuser transport 93, decurler 94, post fuser transport 95, output transport 96, bypass transport 97, and inverter roll 98, cooperate with suitable sheet guides 99 to form a paper path through which the copy sheets being processed pass from either main paper supply tray 34, or auxiliary paper supply tray 36, or duplex paper supply tray 60 through the machine 5 to either top tray 54 or discharge path 58. Transports 91, 92, 93, 94, 95, 96, 97, 98 are suitably driven by main drive motor 29. Suitable sheet sensors designated here by the numeral 67, are provided at the output of each paper tray 34, 36 and duplex tray 60 to detect feeding of a sheet therefrom.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 93 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 94 and post fuser transport 95 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypass gate 52. Thus, copy sheets which bypass inverter 50 turn a 90° corner in the paper bath before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 97 which carries the sheet to duplex gate 56. Gate 56 either directs the sheets without inversion to the discharge path 58 or, when energized, to duplex inverter roll 98. Inverter roll 98 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 98, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 91 and registration transport 92 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the printing machine operator.

Referring particularly to FIG. 3, reproduction machine 5 is segregated into a series of independent modules (termed remotes herein), and identified as finishing output remote (FOR) 9, paper handling remote (PHR) 11, marking and imaging remote (MIR) 13, xerographic remote (XER) 15, recirculating document handler remote (RDHR) 17, and central processing master (CPM) 19, FOR 9, PHR 11, MIR 13, XER 15, RDHR 17, and CPM 19 are communicated with one another by means of a shared communication line (SCL) 25 through which controlled instructions and synchronizing clock pulse signals from and to the machine remotes pass.

Referring particularly to FIGS. 2 and 4, a suitable machine clock pulse generator 100, which is drivingly coupled to the output shaft of main drive motor 29, generates a succession of clock pulses whenever drive motor 29 is energized. As will be understood, to enhance copy throughput, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches with each pitch being composed of approximately 850 machine clock pulses.

Pitch reset signals, which serve in effect to determine the length of the pitch and the number of machine clock pulses within the pitch, are derived from copy sheet registration finger 104. For this purpose, a sensor such as switch 105 is disposed in the path of movement of copy sheet registration fingers 104 such that on each cycle of finger 104 past switch 105, switch 105 outputs a reset signal. The output of machine clock pulses by generator 100 are input through CPM 19 to PHR 11 while the pitch reset signals generated by switch 105 are input directly to PHR 11.

Referring particularly to FIG. 2, to monitor and control movement and processing of the copy sheets moving along the paper path, a series of sensors which may for example comprise switches, are disposed at predetermined jam detection stations along the paper path. More specifically, a pretransfer jam detection station 69 is provided upstream of transfer station D having sheet sensor 70, a pre-fuser jam detection station 71 is provided upstream of fusing station E having sheet sensor 72, a post-fuser jam detection station 73 is provided on the downstream side of fusing station E having sheet sensor 74, an output transport jam detection station 75 is provided at the inlet to output transport 96 having sheet sensor 76, and a bypass jam detection station 77 is provided in the bypass transport 97 upstream of duplex inverter roll 98 having sheet sensor 78. As will appear, sheet sensors 70, 72, 74, 76, 78 serve to monitor movement of the sheet along the paper path.

Figure 6:
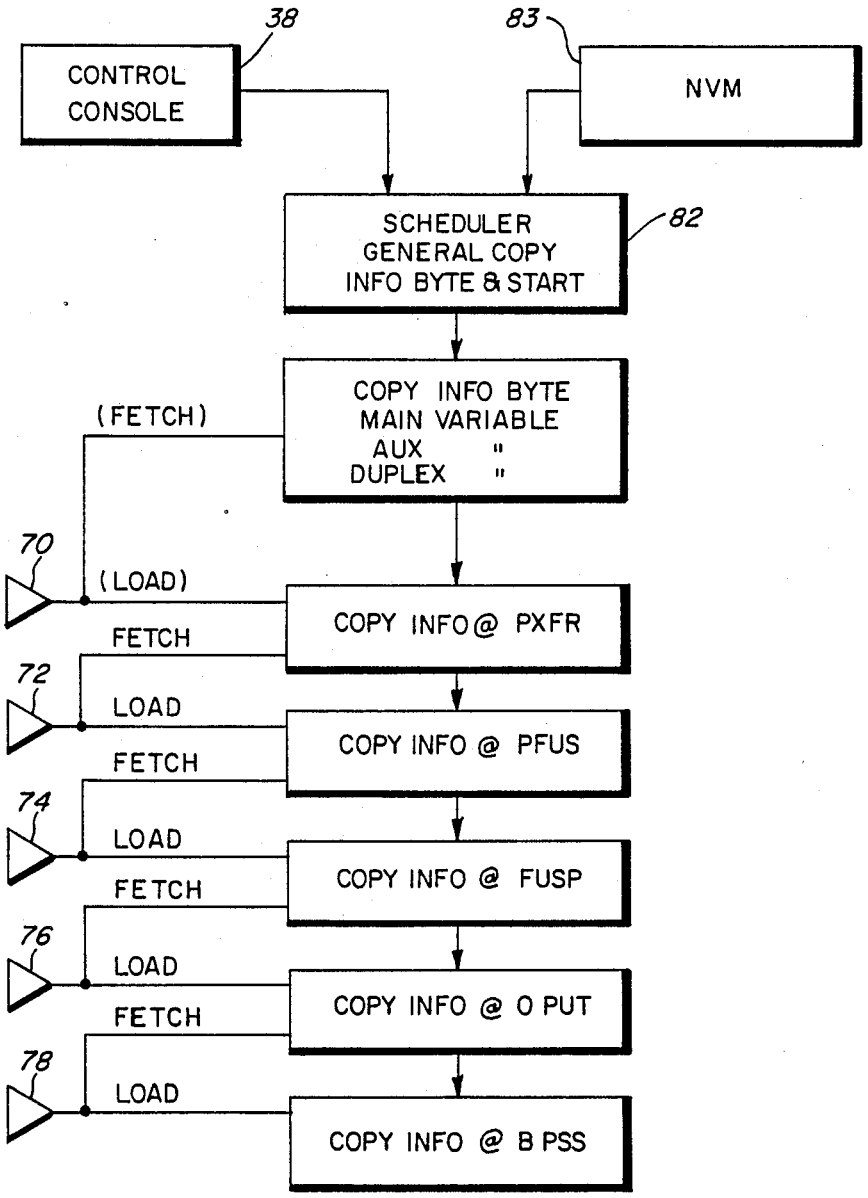
FIG. 6 is a flow chart of the system for passing the information byte in synchronism with movement of the associated copy sheet from one jam detection station to the next.

Referring particularly to FIGS. 1, 5 and 6 of the drawings, to enable the user or operator of reproduction machine 5 to control the machine and program the copy run desired, a suitable operator control panel 38 is provided at some convenient location on machine 5. CPM 19 includes a scheduler 82 for scheduling processing of each copy, the copy run instructions programmed through control panel 38 being input to scheduler 82. As will be understood by those skilled in the art, there is also provided a suitable memory section, exemplified herein by Main Memory Board (MMB) 7 (shown in FIG. 2). MMB 7 normally includes both Read Only Memory (ROM) and Random Access Memory (RAM), and non-volatile memory or NVM 83 wherein data representing the particular machine configuration parameters (i.e. document handler type) and operating parameters (i.e. exposure timing) is stored. Additionally, CPM 19 includes on-board memory such as RAM memory 84. Scheduler 82 responds to the copy run information input by the operator through control panel 38 and the machine configuration and operating parameters input from NVM 83 to generate a copy information byte 89 (COPY @ INFO) for each copy to be made.

In the exemplary arrangement shown, copy information byte 89 contains data identifying the copy sheet source (i.e. tray 34, 36, or 60), the copy destination (i.e. top tray 54, FOR 9, or duplex tray 60), whether the copy is to be inverted or not (i.e. by inverter 50), whether the copy represents the end of the set (i.e. the last copy of a batch), if the sheet is a clearing or purge sheet (normally as a result of a paper jam), and image information related to the particular copy being made (i.e. feed or not feed a sheet). The copy information byte is entered in RAM 84 and held in a suitable memory location or variable, the latter being defined herein as a location in memory where information is stored. The copy information byte 89 as will appear is moved from memory variable to memory variable in synchronism with movement of the copy sheet along the paper path from jam detection station to jam detection station (i.e. from pretransfer jam detection station 69 to prefuser jam detection station 71, from prefuser jam detection station 71 to post fuser jam detection station 73, etc.). In effect, jam detection stations 69, 71, 73, 75 and 77 serve to pass the copy information byte 89 from memory variable to memory variable, the copy information memory variables being identified here and in the drawings and Tables as copy information at pretransfer (COPY INFO @ PXTR), copy information at prefuser (COPY INFO @ PFUS), copy information at the post fuser (COPY INFO @ FUSP), copy information at the output (COPY INFO @ OPUT), and copy information at bypass (COPY INFO @ BPSS). At each memory variable, corresponding to a jam detection station, the copy information byte is read to provide operating instructions for the copier components up to the next jam detection station.

Figure 7:
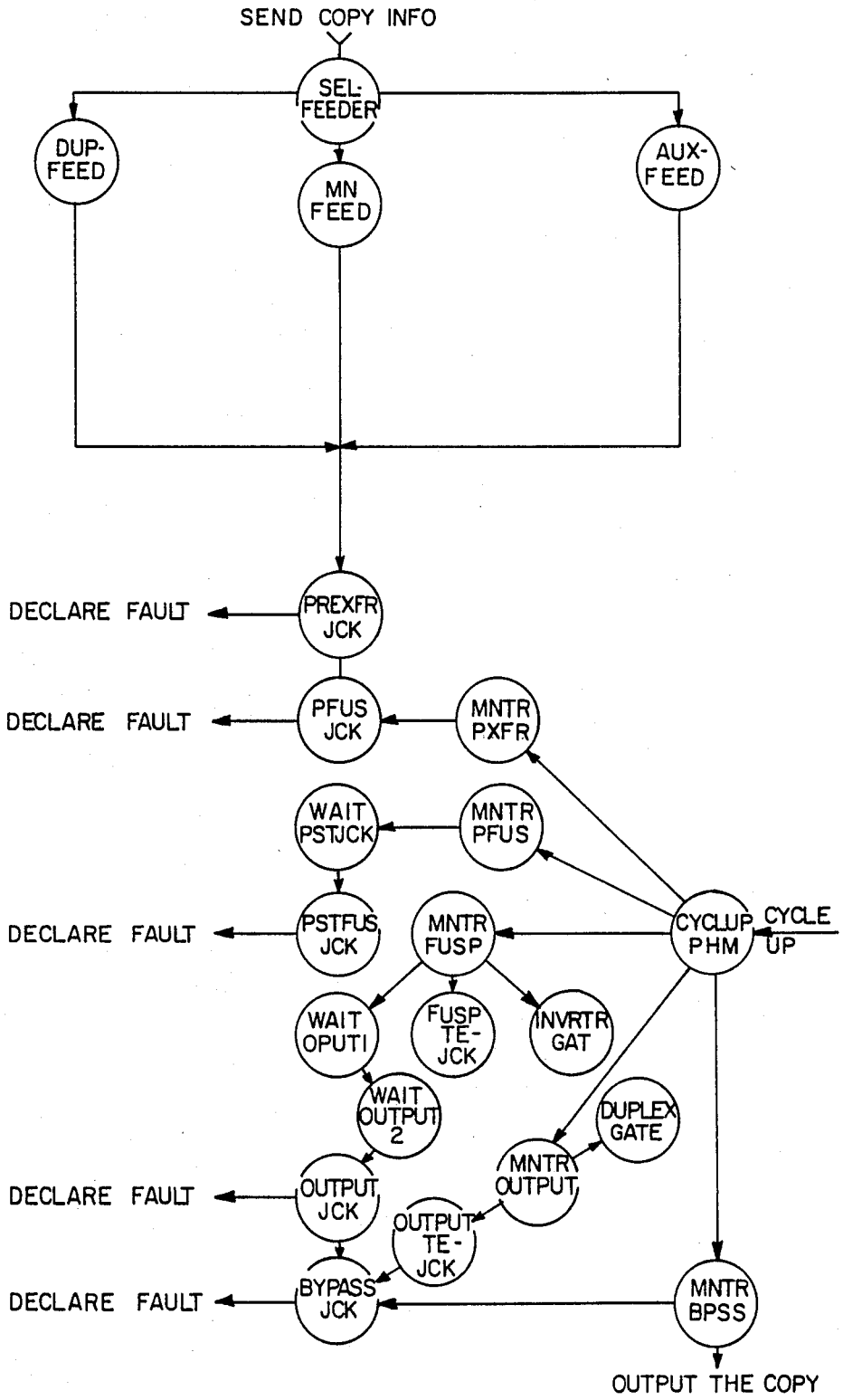
FIG. 7 is a bubble chart of the jam monitoring and checking process.
Figure 8:
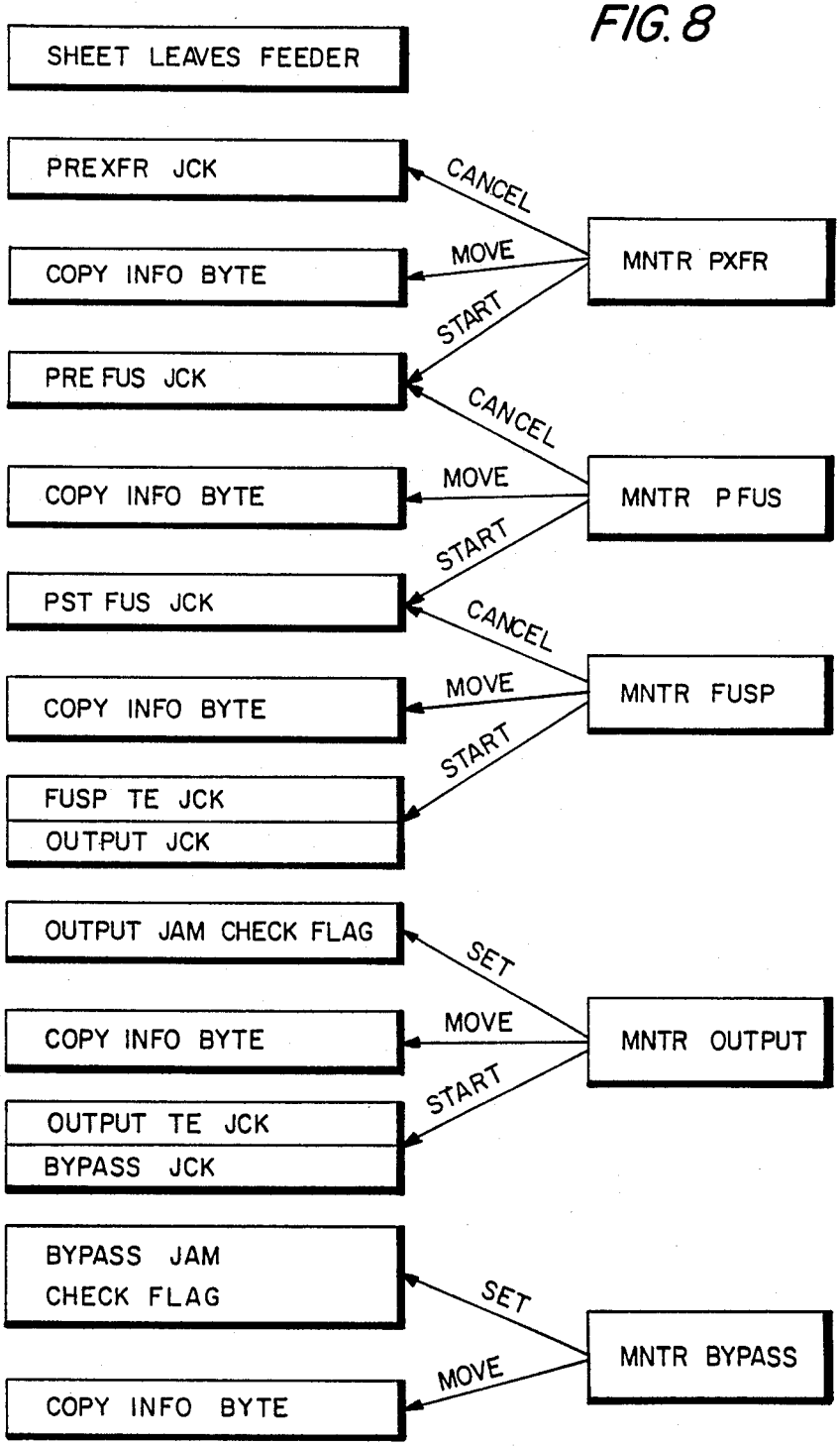
FIG. 8 is a flow chart of the jam monitoring and checking process.

Referring particularly to FIGS. 7 and 8 of the drawings and Tables I-XII, jam monitoring and jam checking routines are associated with each jam detection station. The jam check routines comprise pretransfer jam check (PREXFR JCK, Table I), prefuser jam check (PFEFUS JCK, Table III), post fuser jam check (PSTFUS JCK, Table V), post fuser trailing edge jam check (FUSP TE JCK, Table VII), and output jam check (OUTPUT JCK, Table VIII), output trailing edge jam check (OPUT TE JCK, Table X), and bypass jam check (BYPASS JCK, Table XII). The jam monitoring routines comprise pretransfer monitor (MNTR PXFR, Table II), prefuser monitor (MNTR PFUS, Table IV), post fuser monitor (MNTR FUSP, Table VI), output monitor (MNTR OPUT, Table IX), and bypass monitor (MNTR BPSS, Table XI).

The jam monitoring and jam checking routines cooperate with the sheet sensor (i.e. sensors 70, 72, 74, 76, 78) associated with each jam detection station (i.e. jam detection stations 69, 71, 73, 75, 77) to monitor the paper path for jams and to transfer the copy byte 89 to the memory variable associated with the next jam detection station on arrival of the copy sheet at the jam detection station. The jam monitoring and checking routines are activated on start-up (CYCLE UP PHM) of reproduction machine 5 to look for sheets left over from the previous cycle (Purge). During copying the jam monitoring and checking routines monitor the progress of the copy sheet being processed as the copy sheet moves along the paper path.

The jam monitoring routines function by continuously and repeatedly checking and looking or scanning for and tolling the arrival of the copy sheet at the sensor associated therewith. On detection of the copy sheet, the monitoring routine cancels the current jam check and starts the jam check for the next jam detection station. The jam checking routines check for or toll the arrival of a copy sheet from the previous jam detection station within a preset interval. If not cancelled by the jam monitoring routine associated therewith in response to the arrival of the copy sheet within the interval, the affected jam check routine times out and declares a jam fault.

Referring particularly to FIGS. 1 and 6–8, on start up of reproduction machine 5, the various jam monitoring and jam check routines (Tables I–XII) look for copy sheets left in the paper path from the previous cycle (PURGE). At the instant of start-up, sensors 70, 72, 74, 76, 78 of pretransfer jam detection station 69, prefuser jam detection station 71, post fuser jam detection station 73, output transport jam detection station 75, and bypass jam detection station 77 respectively detect the presence of any copy sheet resting thereon. On detection of a sheet by one of the sensors 70, 72, 74, 76, or 78, the jam monitoring routine associated therewith responds by cancelling the jam check at the jam detection station where the copy sheet was sensed and starting the jam check for the next jam detection station. It is understood that at start-up of reproduction machine 5, main drive motor 29 is energized which, in turn, drives transports 91, 92, 93, 94, 95, 96, 97 and 98. Accordingly, any leftover sheets are transported through the remainder of the paper path to a preselected one of the outputs (i.e. discharge path 58) and movement of the sheet is monitored lest a jam occur as any leftover sheets are being removed.

Where a leftover sheet lies in the space between jam sensors at start-up and hence is not immediately detected, sheet transports 91, 92, 93, 94, 95, 96, 97, 98 carry the sheet forward along the paper path so that the presence of the sheet in the paper path is detected by the next sensor. When the leftover sheet is found by a jam sensor, the jam monitoring routine associated with the jam sensor initiates operation of the jam checking routine for the next jam detection station. Thereafter, movement of the copy sheet along the remainder of the copy path to the sheet destination is monitored.

Following completion of the purge cycle, copy sheets are fed from the paper tray (i.e. main tray 34, auxiliary tray 36 or duplex tray 60) designated by the copy run programmed. On the successful feeding of the copy sheet from the paper tray being used, the tray sensor 67 associated with the tray starts the pretransfer jam checking routine (PXFR JCK, Table I). The copy sheet is carried by vertical transport 91 to registration transport 92 where the sheet is registered by the sheet trailing edge with the image on the belt 10 by registration finger 104. Following registration, the sheet is carried forward to transfer station D where the developed image is transferred from belt 10 to the copy sheet.

As the copy sheet approaches transfer station D, the copy sheet leading edge is sensed by sensor 70 at pretransfer jam detection station 69. Presuming arrival of the copy sheet within the predetermined time interval defined by the pretransfer jam checking routine (PXFR JCK, Table I), the pretransfer jam monitoring routine (MNTR PXFR, Table II) cancels the pretransfer jam check (CANCEL PREXFR JCK), fetches the copy information byte and loads the byte into the pretransfer memory variable (COPY @ INFO @ PXFR), and starts the prefuser jam check (START PREFUS JCK, Table III). As the copy sheet is carried through transfer station D to prefuser jam detection station 71, the prefuser monitoring routine (MNTR PFUS, Table IV), on detection of the copy sheet by sensor 72 within the predetermined time interval defined by the prefuser jam check (PREFUS JCK, Table III), cancels the prefuser jam check (CANCEL PREFUS JCK), fetches the copy information byte and loads the byte into the prefuser memory variable (COPY @ INFO @ PFUS), and starts the post fuser jam check (START WAIT PST JCK, PFUS TE JCK, PSTFUS JCK, Table V).

Movement of the copy sheet through fuser 40 to post fuser jam detection station 73 is monitored by the post fuser monitoring routine (MNTR FUSP, Table VI) and on detection of the copy sheet by sensor 74, the post fuser jam check is cancelled (CANCEL PSTFUS JCK), the copy information byte fetched and loaded into the post fuser memory variable (COPY @ INFO @ FUSP), and the fuser trailing edge jam check (START FUSP TE JCK, Table VII) and the output jam check (START WAIT OPUT 1, WAIT OPUT 2, OUTPUT JCK, Table VIII) started.

The continued movement of the copy sheet along the paper path to output jam detection station 75 is monitored by the output monitoring routine (MNTR OPUT, Table IX). On detection of the copy sheet by sensor 76 of station 75, the output monitoring routine cancels the output jam check (CANCEL OUTPUT JCK, Table VIII) fetches the copy information byte and loads the byte into the output memory variable (COPY @ INFO @ OPUT) and starts the output trailing edge jam check (START OPUT TE JCK).

Movement of the copy sheet to the bypass jam detection station 77 is monitored by the bypass monitoring routine (MNTR BPSS, Table XI). On detection by sensor 78, the bypass monitoring routine starts the bypass jam check (START BYPASS JCK, Table XII) and fetches the copy information byte and loads the byte into the bypass memory variable (COPY @ INFO @ BPSS).

Figure 9:
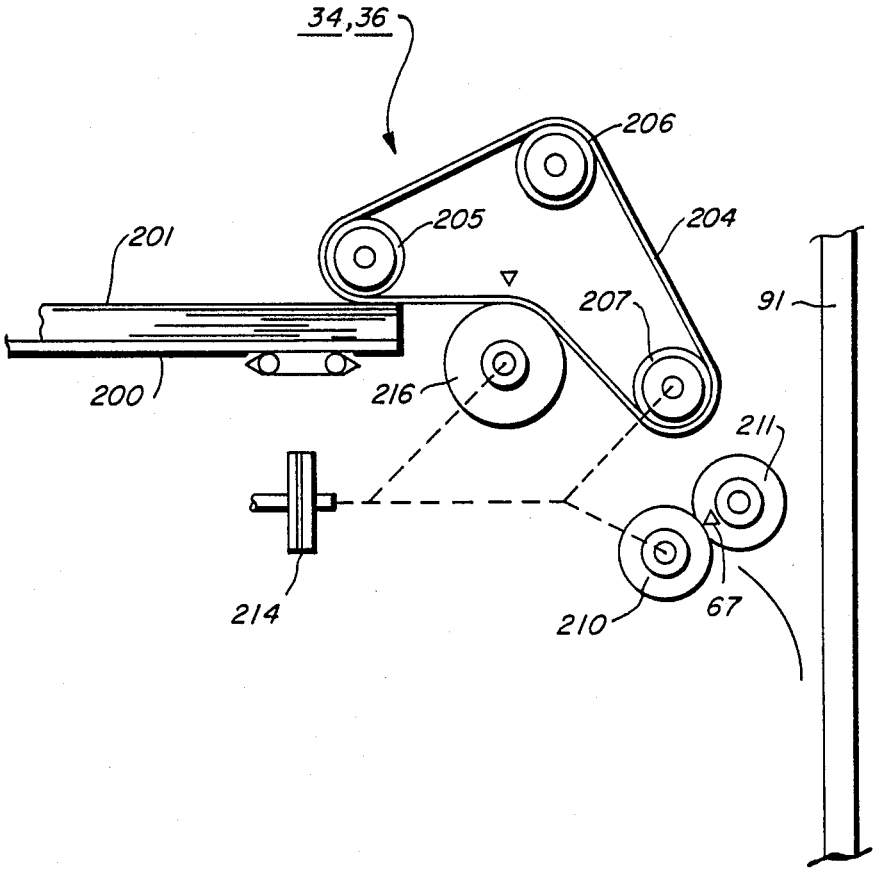
FIG. 9 is a side view in cross section showing details of the main and auxiliary paper trays.

Referring to FIG. 9 of the drawings, main and auxiliary paper trays 34, 36 respectively each include a movable sheet elevator or base 200 on which a supply 201 of copy sheets is stacked. Suitable guides (not shown) cooperate to retain the copy sheet sides and ends in desired position on base. 200. A copy sheet feeder in the form of a feed belt 204 supported for rotation by rollers 205, 206, 207 so that one end engages the topmost sheet of the sheet stack 201 to feed the topmost sheet forward into the nip provided by take away roll pair 210, 211 is provided. Copy sheets are discharged by take away roll pair 210, 211 onto the vertical transport 91. Feed belt 204 and take away roll pair 210, 211 are driven by main drive motor 29 through clutch 214.

To prevent feeding of multiple copy sheets at once, a retard roll 216 is provided, roll 216 cooperating with sheet feed belt 204 to form a nip between which copy sheets are fed. Retard roll 216 is rotated by suitable drive means (not shown) at a relatively slow speed in a direction opposite to the direction of movement of feed belt 204 to limit feeding of sheets to one sheet at a time. Sheet sensor 67 is disposed adjacent the tray outlet to detect feeding a sheet as described heretofore. In the event that a copy sheet following feeding fails to arrive at the required jam detection station on time, a jam is declared and the reproduction machine 5 is cycled down.

To facilitate servicing and loading of paper trays 34, 36, each tray is mounted as a unit for slidable movement into and out of the reproduction machine housing by suitable means (not shown). However, in the case where, due to a fault condition, such as a misfeed, the paper tray feeder is prematurely stopped, a partially fed sheet of copy paper may be left in the nip of the tray take away roll pair (i.e. roll pair 210, 211) with some portion of the sheet forward or leading end projecting forward from the tray area toward vertical transport 91. Inasmuch as the trays 34, 36 are designed to be drawn outwardly when loading and servicing is required, doing so following a premature stop may jam the partially fed sheet of copy paper against other machine structures and components distorting and tearing the copy sheet and rendering clearing of the copy sheet and restarting of the reproduction machine more difficult and time consuming.

To obviate this problem, and referring to Tables XIII–XVI, a jam clearing routine (PURGE FEEDER) is provided for temporarily actuating the sheet feed mechanism of the paper tray 34, 36 in use following a paper tray fault in an effort to move any partially fed sheet out of the paper tray and into the main paper path. There, removal of the copy sheet is facilitated. At the same time, any servicing of the paper tray that is required prior to restarting of the reproduction machine is facilitated by the ability to draw the tray out from the machine housing without interference or restriction.

Where during operation of reproduction machine 5 a sheet feed fault occurs in the paper tray 34 or 36 then in use, the sensor 67 associated therewith detects the fault and cycles down reproduction machine 5. On restart (CYCUP MNDR, Table XIII), the jam clearing routine (PURGE FDR, Table XIV) is entered in an effort to complete movement of any partially fed sheet out of the paper tray and into the paper path, the jam clearing routine actuating the main drive motor 29 and the paper tray clutch 214 (TAR) to drive the paper path transports and tray copy sheet feeder for a preset interval sufficient to advance any partially fed copy sheet forward to vertical transport 91. Following the preset interval (WAIT JCK and WAIT JCK 1, Tables XIV and XVI respectively), the duration of which is sufficient to move any partially fed sheet from the paper tray area at least to vertical transport 91, main drive motor 29 and paper tray clutch 214 are inactivated to stop the paper path transports and the tray copy sheet feeder.

Where the partially fed copy sheet is moved from the paper tray to vertical transport 91 and the main paper path, the copy sheet trailing edge is detected by tray sensor 67 as the sheet passes thereby. The resulting signal from sensor 67 sets a flag indicating the presence of the copy sheet in the main paper path, signaling the operator that transport 91 must be cleared before operation of machine 5 can be resumed.

Should the partially fed copy sheet fail to move within the preset interval, the original fault condition remains. In that event, the affected tray must be opened despite the presence of the partially fed copy sheet to remove the sheet and clear the fault.

Where shutdown of reproduction machine 5 (CYCDN MDRV, Table XVII) occurs while a copy sheet is in the process of being fed from either the main or auxiliary paper tray 34, 36 then in use, the clutch 214 for the paper tray copy sheet feeder is set (i.e. MAIN TAR ON or AUX TAR ON). On subsequent restarting of the paper path transports (i.e. transports 91, 92, 93, 94, 95, 96, 97, 98), the paper tray copy sheet feeder is simultaneously actuated to feed the partially fed sheet forward to vertical transport 91 and the main paper path. There the sheet is purged from the main paper path in the same manner as any leftover copy sheet as described heretofore.

While the invention has been described with reference to the structure disclosed, it is not confined to the details set forth, but is intended to cover such modifications or changes as may come within the scope of the following claims.

TABLE I

PERFORM PRETRANSFER CHECK
(PREXFR_JCK)(COPY@INFO:BYTE)

WAITS FOR A PERIOD OF TIME AFTER NOMINAL SHEET ARRIVAL TIME TO PERFORM JAM CHECK BY CHECKING FLAG SET BY MONITOR PROCEDURE AT LEAD EDGE ARRIVAL

```
103 ENTER;
104 COPY@INFO@PXFR ← COPY@INFO;
105 WAIT PXFR@JAMCK@TM MC;
106 START INCREMENT_COUNTER (PXFER@JAM@CNT);
107 START DECLARE_FAULT (PREXFERJAM);
108 END; /* END ENTER */
```

LEGEND:
COPY INFO: Copy Information Byte
PREXFR JCK: Pretransfer Jam Check

TABLE II

MONITOR PRETRANSFER SWITCH
(MNTR_PXFR)

AT STARTUP, CHECKS FOR PAPER AT PRE-TRANSFER SWITCH. IF TRUE THEN WAITS AND CHECKS AGAIN TO INSURE THAT PAPER LEFT THE SWITCH. ON A CONTINUOUS BASIS, THE PROCEDURE CHECKS FOR A SHEET ARRIVAL AND THEN INITIATES THE NEXT SWITCH CHECK (PREFUSER).

```
43 ENTER;
44 /* STARTED BY CYCLEUP_PHM PROCEDURE */
45 IF PRE#XFER = PAPER THEN BEGIN;
46 CANCEL PREXFR_JCK;
47 START PREFUS_JCK;
48 END; /* END BEGIN */
49 SHT LOOP FOREVER;
50 RACE2 RACE;
51 CASE NEXTIME PRE#XFER = PAPER;
52 CANCEL PREXFR_JCK;
53 START INCREMENT_COUNTER (PXFER@DLVRY);
54 START PREFUS_JCK;
55 END RACE2;
56 RELOOP SHT;
57 END;
```

LEGEND:
PREFUS JCK: Prefuser Jam Check
SHT: Sheet
MNTR PXFR: Monitor Pretransfer

TABLE III

PERFORM PREFUSER CHECK
(PREFUS_JCK)

WAITS FOR A PERIOD OF TIME AFTER NOMINAL SHEET ARRIVAL TIME TO PERFORM JAM CHECK BY CHECKING FLAG SET BY MONITOR PROCEDURE AT LEAD EDGE ARRIVAL

```
134 ENTER;
135 COPY@INFO@PFUS ← COPY@INFO@PXFR;
136 WAIT 710 MC;
137 IF TE@JAM@SET = CLEAR THEN BEGIN;
```

TABLE III-continued

```
138 START INCREMENT_COUNTER (PFUS@JAM@CNT);
139 START DECLARE_FAULT (PREFUSJAM);
140 END; /* IF */
141 END; /* END ENTER */
```

TABLE IV

MONITOR PREFUSER SWITCH
(MNTR_PFUS)

ON STARTUP, CHECKS SWITCH FOR PAPER TO START WAIT_PSTJCK PROCEDURE. ON A CONTINUOUS BASIS, STARTS WAIT_PSTJCK PROCEDURE.

```
78 ENTER;
79 /* STARTED BY CYCLEUP_PHM PROCEDURE */
80 IF PRE#FUS = PAPER THEN BEGIN;
81 CANCEL PREFUS_JCK;
82 START WAIT_PSTJCK;
83 START PFUS_TE_JCK;
84 END; /* END BEGIN */
85 SHT LOOP FOREVER;
86 RACE2 RACE;
87 CASE NEXTIME PRE#FUS = PAPER;
88 CANCEL PREFUS_JCK;
89 START PFUS_TE_JCK;
90 WAIT 130 MC;
91 START WAIT_PSTJCK;
92 END RACE2;
93 RELOOP SHT;
94 END;
```

LEGEND:
PST JCK: Post-fuser Jam Check
PFUS TE JCK: Prefuser Trailing Edge Jam Check
MNTR PFUS: Monitor Prefuser

TABLE V

PERFORM POSTFUSER CHECK
(WAIT_PSTJCK)(PFUS_TE_JCK)(PSTFUS_JCK)

WAITS ABOUT A PERIOD OF TIME AFTER NOMINAL SHEET ARRIVAL TIME TO PERFORM JAM CHECK BY CHECKING FLAG SET BY MONITOR PROCEDURE AT LEAD EDGE ARRIVAL

```
198 ENTER;
199 COPY@INFO@WPSTJC ← COPY@INFO@PFUS;
200 WAIT 350 M ;
201 COPY@INFO@WPSTJC2 ← COPY@INFO@WPSTJC;
202 WAIT 150 MC;
203 START PSTFUS_JCK;
204 END;
169 ENTER;
170 RACE1 RACE;
171 CASE PRE#FUS = NO_PAPER;
172 PAPER@PATH ← SET;
173 PAPER@FUSER ← SET;
174 CASE PFUS@TEJAMCK@TM MC;
175 START DECLARE_FAULT (PREFUSTEJAM);
176 TE@JAM@SET ← SET;
177 START INCREMENT_COUNTER (PFUS@JAM@CNT);
178 END RACE1;
179 END; /* ENTER */

229 ENTER;
230 WAIT 390 MC;
231 OF FUSP@SHT@B = PAPER@ARRIVED THEN BEGIN;
```

TABLE V-continued

```
232 FUSP@SHT@B ← CLEAR;
233 END; /* IF */
234 ELSE BEGIN;
235 IF TE@JAM@SET = CLEAR THEN BEGIN;
236 START INCREMENT_COUNTER (PSTFUS@CNT);
237 START DECLARE_FAULT (POSTFUSJAM);
238 END; /* IF */
239 END; /* ELSE */
240 END; /* END ENTER */
```

TABLE VI

MONITOR POSTFUSER SWITCH
(MNTR_FUSP)

ON STARTUP, IF PAPER IS AT POSTFUSER SWITCH, STARTS POST FUSER TRAIL EDGE JAM CHECK. ON A CONTINUOUS BASIS, WHEN A SHEET ARRIVES AT SWITCH, A FLAG IS SET AND THE POST FUSER TRAIL EDGE JAM CHECK, INVERTER GATE, AND WAIT-OUTPUT PROCEDURES ARE STARTED.

```
124 ENTER;
125 /*STARTED BY CYCLEUP_PHM PROCEDURE */
126 IF POST#FUS = PAPER THEN BEGIN;
127 CANCEL PSTFUS_JCK;
128 CANCEL WAIT_PSTJCK;
129 START FUSP_TE_JCK;
130 END; /* END BEGIN */
131 SHT LOOP FOREVER;
132 RACE2 RACE;
133 CASE NEXTIME POST#FUS = PAPER;
134 FUSP@SHT@B← PAPER@;
135 COPY@INFO@FUSP ← COPY@INFO@WPSTJC2;
136 START FUSP _TE_JCK;
137 START INVRTR_GAT;
138 START WAIT_OPUT1;
139 END RACE2;
140 RELOOP SHT;
141 END;
```

LEGEND:
MNTR FUSP: Monitor Post-Fuser
FUSP TE JCK: Post-fuser Trailing Edge Jam Check

TABLE VII

FUSP_TE_JCK

PERFORMS A TRAIL EDGE JAM CHECK ON POSTFUSER JAM SWITCH

```
272 ENTER;
273 RACE1 RACE;
274 CASE POST#FUS = NO_PAPER;
275 IF PURGE@PATH = CLEAR THEN BEGIN;
276 IF (!ACTIVE(WAIT_PSTJCK)) &
    (!ACTIVE(PSTFUS_JCK)) THEN BEGIN;
277 PAPER@FUSER ← CLEAR;
278 END; /* IF */
279 END; /* IF */
280 CASE FUSP@TEJAMCK@TM MC;
281 START DECLARE_FAULT (POSTFUSTEJAM);
282 TE@JAM@SET ← SET;
283 START INCREMENT_COUNTER (PSTFUS@CNT);
284 END RACE1;
285 END; /* ENTER */
```

TABLE VIII

PERFORM OUTPUT CHECK
(WAIT_OPUT1)(WAIT_OPUT2)(OUTPUT_JCK)

WAITS FOR A PERIOD OF TIME AFTER NOMINAL ARRIVIAL TIME TO CHECK FLAG INDICATING SHEET ARRIVAL FOR JAM CHECKING

```
168 ENTER;
169 WAIT 550 MC;
170 COPY@INFO@WOPUT1 ← COPY@INFO@FUSP;
171 START WAIT_OPUT2;
```

TABLE VIII-continued

```
172 IF (COPY@INFO@WOPUT1 & DEST@MASK) = FINISHER THEN BEGIN;
173 START OUTPUT_INTERFACE (CYCLEUP, NORMAL);
174 END; /* IF */
175 END; /* ENTER */

195 ENTER;
196 IF (COPY@I FO@INVRTR & INV@MASK) = INVERT THEN BEGIN;
197 WAIT 450 MC;
198 END; /* IF */
199 ELSE BEGIN;
200 WAIT 100 MC;
201 END; /* ELSE */
202 COPY@INFO@INFO@WOPUT2 ← COPY@INFO@WPOUT1;
203 START OUTPUT_JCK;
204 END; /* ENTER */

312 ENTER;
313 /*SHOULD NOT BE ACTIVE FOR MORE THAN ABOUT 500 MC */
314 WAIT OPUT@JAMCK@TM MC; /* ADDITIONAL WAIT IN INVRTR_GAT PROCEDURE */
315 IF OPUT@SHT@B = PAPER@ARRIVED THEN BEGIN;
316 OPUT@SHT@B ← CLEAR;
317 END; /* IF */
318 ELSE BEGIN;
319 START INCREMENT_COUNTER (OUTPUT@J@CNT);
320 START DECLARE_FAULT (OUTPUTJAM);
321 END; /* ELSE */
322 END; /* END ENTER */
```

TABLE IX

MONITOR COPYOUT JAM SWITCH
(MNTR_OPUT)

ON STARTUP, IF A SHEET IS AT THE OUTPUT SWITCH THEN OUTPUT JAM CHECK IS STARTED. ON A CONTINUOUS BASIS, WHEN A LEAD EDGE IS DETECTED AT THE OUTPUT SWITCH, THE OUTPUT JAM CHECK AND THE DUPLEX GATE PROCEDURES ARE STARTED.

```
231 ENTER;
232 /* STARTED BY CYCLEUP_PHM PROCEDURE */
233 IF COPY#OUT = PAPER THEN BEGIN;
234 CANCEL OUTPUT_JCK;
235 START OPUT_TE_JCK;
236 END, /* END BEGIN */
237 SHT LOOP FOREVER;
238 RACE2 RACE;
239 CASE NEXTIME COPY#OUT = PAPER;
240 OPUT@SHT@B ← PAPER@;
241 COPY@INFO@@oput ← COPY@INFO@WOPUT2;
242 START OPUT_TE_JCK;
243 START DUPLEX_GAT;
244 END RACE2;
245 RELOOP SHT;
```

TABLE IX-continued

```
246 END;
```

LEGEND:
MNTR OPUT: Monitor output
OUTPUT JCK: Output Jam Check
OPUT TE JCK: Output Trailing Edge Jam Check

TABLE X

PERFORM TRAIL EDGE JAM CHECK ON COPYOUT SWITCH
(OPUT_TE_JCK)

PERFORM TRAIL EDGE JAM CHECK ON COPYOUT SWITCH

```
350 ENTER;
351 RACE1 RACE;
352 CASE COPY#OUT = NO_PAPER;
353 START BYPASS_JCK;
354 IF (COPY@INFO@OPUT & DEST@MASK) =
    FACEUP THEN BEGIN;
355 START COUNT_DELIVERY (COPY@INFO@OPUT);
356 END; /* IF */
357 CASE OPUT@TEJAMCK@TM MC;
358 START DECLARE_FAULT (OUTPUTTEJAM);
359 START INCREMENT_COUNTER (OUTPUT@J@CNT);
360 END RACE1;
361 END; /* ENTER */
```

TABLE XI

MONITOR BYPASS SWITCH
(MNTR_BPSS)

ON STARTUP, IF PAPER IS AT THE BYPASS SWITCH, THEN THE BYPASS JAM CHECK IS STARTED. ON A CONTINUOUS BASIS, IF A LEAD EDGE IS DETECTED, OBTAINS COPY INFO BYTE FROM OUTPUT CHECK BYTE. WHEN THE TRAIL EDGE IS DETECTED, START OUTPUT THE COPY PROCEDURE. IF THE DESTINATION IS THE DUPLEX TRAY, START COUNT DELIVERY, PREFEED DUPLEX FEEDER AND FLIP SET SEPARATOR.

```
295 ENTER;
296 /* STARTED BY CYCLEUP_PHM PROCEDURE */
297 IF BYPASS#T = PAPER THEN BEGIN;
298 START BYPASS_JCK;
299 END; /* END BEGIN */
300 GAP LOOP FOREVER;
301 RACE2 RACE;
302 CASE NEXTIME BYPASS#T = PAPER;
303 CASE NEXTIME BYPASS#T = NO_PAPER;
```

TABLE XI-continued

```
304 IF ACTIVE (BYPASS_JCK) THEN BEGIN;
305 BPSS@GAP@B ← TRUE;
306 END; /* IF */
307 START OUTPUT_INTERFACE (OUTPUTCOPY,COPY@INFO@BPSS);
308 START INCREMENT_COUNTER (BYPASS@DLVRY);
309 IF (COPY@INFO@BPSS & DEST@INFO@BPSS & DEST@MASK) = DUPLEX THEN BEGIN;
310 START COUNT_DELIVERY (COPY@INFO@BPSS);
311 WAIT SETTLE@TIME MS; /* FOR PAPER TO SETTLE IN THE TRAY */
312 START FLIP_SET_SEP;
313 RDY4@DUP@PREFD ← SET;
314 END; /* IF */
315 END RACE2;
316 RELOOP GAP;
317 END;
```

LEGEND:
MNTR BPSS: Monitor Bypass

TABLE XII

BYPASS_JCK

```
391 ENTER;
392 COPY@INFO@BPSS ← COPY@INFO@OPUT;
393 WAIT BPSS@JAMCK@TM MC;
394 IF ((COPY@INFO@BPSS & DEST@MASK) = DUPLEX) /
395 ((COPY@INFO@BPSS & DEST@MASK) =
    FINISHER) THEN BEGIN;
396 IF BPSS@GAP@B = TRUE THEN BEGIN;
397 BPSS@GAP@B ← CLEAR;
398 END;
399 ELSE BEGIN;
400 START INCREMENT_COUNTER (BYPASS@J@CNT);
401 START DECLARE_FAULT (BYPASSJAM);
402 END; /* ELSE */
403 END; /* IF */
404 ELSE BEGIN;
405 IF BPSS@GAP@B = TRUE THEN BEGIN;
    /* PAPER SHOULD GO TO FACEUP TRAY */
406 START INCREMENT_COUNTER (BYPASS@J@CNT);
407 START DECLARE_FAULT (BYPASSJAM);
408 END; /* IF */
409 END; /* ELSE */
```

LEGEND:
BYPASS JCK: Bypass Jam Check

TABLE XIII

CYCUP_MDRV

SYSTEMATICALLY BRINGS UP THE MAIN DRIVE AND ASSOCIATED PROCEDURES

```
    /* IF */
156 IF (PURGE@MNFDR = SET) & (MAIN#WT =
    PAPER) THEN BEGIN;
157 START PURGE_FDR (MNFDR);
158 END; /* IF */
159 PURGE@MNFDR ← CLEAR;
160 IF (PURGE@AXFDR = SET) & (AUX#WT =
    PAPER) THEN BEGIN;
161 START PURGE_FDR (AXFDR);
162 END; /* IF */
163 PURGE@AXFDR ← CLEAR;
```

LEGEND:
CYCUP MDRV: Cycle Up Main Drive
MNFDR: Main Feeder
AXFDR: Auxiliary Feeder .

TABLE XIV

PURGE FEEDER
(PURGE_FDR)

PURGES A SHEET FROM THE MAIN OR AUX FEEDER THAT IS AT IT'S WAIT STATION. AFTER PURGE THE SELECTED FEEDER PREFEED ROUTINE IS INITIATED.

```
513 ENTER;
514 IF FEEDER = MAIN THEN BEGIN;
515 MAIN$SFR ← ON;
```

TABLE XIV-continued

```
516 MAIN$TAR ← ON;
517 RACE;
518 CASE MAIN#WT = NO_PAPER;
519 START WAIT_JCK (COPY@INFO,MAIN);
520 PAPER@MN@WAIT ← CLEAR;
521 CASE FDR@JAMCK@TM MC;
522 START DECLARE_FAULT (MNFEEDJAM);
523 END; /* RACE */
524 MAIN$SFR ← OFF;
525 MAIN$TAR ← OFF;
526 IF JOB@SELECTION (TRAY) = MAIN THEN BEGIN;
527 START PRF_MN_FDR;
528 END; /* IF */
529 END; /* BEGIN */
530 IF FEEDER = AUX THEN BEGIN;
531 AUX$SFR ← ON;
532 AUX$TAR ← ON;
533 RACE;
534 CASE AUX#WT = NO_PAPER;
535 START WAIT_JCK1 (COPY@INFO,AUX);
536 PAPER@AX@WAIT ← CLEAR;
537 CASE FDR@JAMCK@TM MC;
538 START DECLARE_FAULT (AXFEEDJAM);
539 END; /* RACE */
540 AUX$SFR ← OFF;
541 AUX$TAR ← OFF;
542 IF JOB@SELECTION(TRAY) = AUX THEN BEGIN;
543 START PRF_AUX_FDR;
544 END; /* IF */
545 END; /* IF */
546 END;
```

LEGEND:
PURGE FDR: Purge Feeder
MAIN SFR: Main Sheet Feeder
MAIN TAR: Main Take Away Roll
PRF MN FDR: Prefeed Main Feeder
AUX SFR: Auxiliary Sheet Feeder
AUX TAR: Auxiliary Take Away Roll
PRF AUX FDR: Prefeed Auxiliary Feeder

TABLE XV

WAIT_JCK

```
50 COPY@INFO@WJCK ← COPY@INFO;
51 IF TRAY = MAIN THEN BEGIN;
52 WAIT 420 MC;
53 END; /* END BEGIN */
54 ELSE BEGIN;
55 WAIT 700 MC;
56 END; /* END BEGIN */
57 START WAIT_JCK1 (COPY@INFO@WJCK,TRAY);
58 END;
```

TABLE XVI

WAIT_JCK1

```
77 ENTER;
78 COPY@INFO@WJCK1 ← COPY@INFO;
79 WAIT 780 MC;
```

TABLE XVI-continued

```
80 START PREX. R_JCK (COPY@INFO@WJCK1);
81 END; /* ENTER */
```

TABLE XVII

CYCLEDOWN MAIN DRIVE
(CYCDN_MDRV)

PERFORMS AN ORDERLY SHUTDOWN OF THE MACHINE STARTING & CANCELING PROCEDURES, AND PERFORMING FUNCTIONS DURING THE 7 PITCHES IN CYCLING DOWN THE MACHINE WHEN THE LAST PAPER IS OUT OF THE MACHINE & THE DUPLEX TRAY HAS HAD TIME TO PREFEED, THE RUN RELAY IS DE-ENERGIZED.

```
330 IF FIND_FAULT (MNFEEDJAM) ! =
    CLEAR@ THEN BEGIN;
331 IF MAIN#WT = PAPER THEN BEGIN;
332 MAINSTAR ← ON;
333 RACE1 RACE;
334 CASE MAIN#WT = NO_PAPER;
335 JAM@CLEARED ← MAIN;
336 CASE 400 MC;
337 END RACE1;
338 MAINSTAR ← OFF;
339 END; /* IF */
340 END; /* IF */
341 IF FIND_FAULT (AXFEEDJAM) ! =

11 CLEAR@ THEN BEGIN;
342 IF AUX#WT = PAPER THEN BEGIN;
343 AUXSTAR ← ON;
344 RACE2 RACE;
345 CASE AUX#WT = NO_PAPER;
346 JAM@CLEARED ← AUX;
347 CASE 400 MC;
348 END RACE2;
349 AUXSTAR ← OFF;
350 END; /* IF */
351 END; /* IF */
352 /* CALL */

382 TEST JAM@CLEARED;
383 CASE = MAIN;
384 WAIT 200 MS;
385 START DECLARE_FAULT (CLEARZONE1);
386 START FAULT_MANAGER (MNFEEDJAM,1,CLEAR);
387 PAPER@MN@WAIT ← CLEAR;
388 CASE = AUX;
389 WAIT 200 MS;
390 START DECLARE_FAULT (CLEARZONE1);
391 START FAULT_MANAGER (AXFEEDJAM,1,CLEAR);
392 PAPER@AX@WAIT ← CLEAR;
393 END; /* TEST */
394 JAM@CLEARED ← CLEAR;
```

LEGEND:
MAIN TAR: Main Paper Tray Take Away Roll
AUX TAR: Auxiliary Paper Tray Take Away Roll

I claim:

1. In a reproduction machine the combination of:

(a) means forming a path along which a copy sheet being processed passes;

(b) transport means for moving said copy sheet along said path, (c) a plurality of discrete copy sheet monitoring stations disposed in preset locations along said path for monitoring movement of said copy sheet along said path;

(d) control means for enabling said monitoring stations whereby each of said monitoring stations scans said path for said copy sheet, the next one of each of said monitoring stations commencing tolling of a predetermined timed interval in response to detection of said copy sheet by the preceding one of said monitoring stations for said copy sheet to reach said next monitoring station whereby movement of said sheet along said path is monitored;

(e) copy processing information means providing information for processing said copy sheet, (f) means forming a plurality of locations where said copy processing information may be read to obtain instructions for processing said copy sheet; and (g) means for advancing said copy processing information from location to location in response to detection of said copy sheet by each of said monitoring stations along said path in succession.

2. In a reproduction machine having a paper path along which copy sheets pass, said paper path having at least one sheet removal location along said paper path where removal of a jammed sheet is facilitated, and feeder means for transporting copy sheets from a copy sheet source in succession along the paper path, the combination of:

(a) sheet jam detecting means for monitoring movement of said copy sheets along said path;

(b) control means responsive to detection of a sheet jam by said jam detecting means to render said feeder means inoperative whereby to stop feeding of copy sheets along said path pending clearing of said jam; and (c) jam clearance means operative to temporarily reactuate said feeder means in an attempt to move the jammed sheet from the jam location along said path to said sheet removal location whereat removing of said jammed sheet from said paper path is facilitated.

3. In a reproduction machine for producing copies, the combination of:

(a) means forming a copy processing path along which copy sheets are moved during operation of said machine, said copy processing path forming means including (1) plural alternative path segments, and (2) control gates at the entrance to said alternative path segments for routing copy sheets selectively to one or the other of said alternative path segments;

(b) a succession of sheet jam monitoring stations at predetermined locations along said copy processing path;

(c) means providing copy sheet processing instructions with each of said copy sheets, said instructions including an instruction identifying the processing route to be followed by the copy sheet associated therewith along said copy processing path;

(d) means for reading said copy sheet instructions in response to detecting of the sheet associated therewith at said jam monitoring stations to identify the processing route to be followed by said copy sheet to the next jam monitoring station; and (e) means for setting any of said control gates in the copy processing path to the next succeeding jam monitoring station in response to said instructions whereby to route said copy sheet to the processing path segment required.

4. The method of operating a reproduction machine to produce copies having a paper path along which copy sheets are moved while producing copies, transport means for moving copy sheets along said path, and a plurality of sheet jam detecting stations at predetermined locations along said path, comprising the steps of:

(a) scanning for a copy sheet at each of said stations;

(b) on detecting a copy sheet at one of said stations, initiating a jam check providing a predetermined timed interval within which said sheet must reach the next one of said stations;

(c) either clearing said jam check in response to detection of said sheet at said next station within said predetermined timed interval or generating a fault in response to failure of said sheet to reach said next station within said timed interval;

(d) repeating steps b and c for each succeeding station along said path;

(e) providing discrete copy processing instructions for each of said copy sheets; and (f) reading said copy processing instructions in response to detection of the copy sheet associated therewith at each of said stations to obtain instructions for processing said copy sheet as said copy sheet moves along said paper path to the next one of said stations.

5. The process according to claim 4 in which said machine includes at least one copy sheet supply tray with feeder means for feeding sheets from said supply tray into said paper path, including the steps of:

(a) monitoring said paper tray for jams;

(b) interrupting operation of said feeder means in response to a jam; and (c) reactuating said feeder means for a preset interval in an attempt to move any partially fed copy sheet from said paper tray into said paper path to facilitate clearing of said sheet.

6. A process for monitoring movement of copy sheets along the paper path of a reproduction machine, the machine having transport means for moving copy sheets along said paper path and a plurality of discrete copy sheet jam monitors disposed in succession along said paper path, the steps which comprise:

(a) actuating said jam monitors to look for a copy sheet;

(b) pending detection of a copy sheet, placing said jam monitors in condition to repeatedly check for the arrival of a copy sheet at said jam monitor locations;

(c) where a copy sheet is detected by one of said jam monitors, implementing a timed cycle within which said sheet must reach the next succeeding one of said jam monitors;

(d) interrupting operation of said machine on failure of said copy sheet to arrive at said next jam monitor within said predetermined timed cycle;

(e) repeating steps b, c and d for each jam monitor location along said paper path;

(f) providing discrete copy processing information for each copy sheet; and (g) reading said copy processing information each time the copy sheet associated therewith is detected by one of said jam monitors to provide information for processing said copy sheet in the interval while said copy sheet moves along said paper path to the next one of said jam monitors.

7. A process for facilitating clearing of a partially fed sheet from the paper supply tray of a reproduction machine following interruption of the supply tray paper feeder supplying copy sheets from said tray to the reproduction machine paper path in response to a fault, the steps comprising:

(a) overriding said fault and starting said paper feeder in an attempt to move said partially fed sheet forward into said paper path;

(b) terminating actuation of said paper feeder following a predetermined interval; and (c) monitoring movement of said partially fed sheet to identify a new location of said sheet where said sheet is moved.

8. The process of starting up a reproduction machine having a paper path along which copy sheets being processed move together with transport means for moving said copy sheets along said paper path and at least one sheet supply tray having sheet feeder means for feeding fresh copy sheets into said paper path, the steps which comprise:

(a) starting said transport means to remove any copy sheets left in said paper path;

(b) scanning said paper path at predetermined locations along said paper path to detect any leftover copy sheets;

(c) on detecting a leftover copy sheet in said paper path at one of said locations, initiating a timed cycle for movement of said leftover copy sheet from said one location to the next second location;

(d) where said leftover copy sheet fails to reach said second location within said timed cycle, declaring a fault;

(e) where said leftover copy sheet reaches said second location within said timed cycle, instituting another timed cycle for movement of said leftover copy sheet from said second location to the next third location; and (f) repeating steps c and d until said paper path is cleared.

9. The process of starting up a reproduction machine having a paper path along which copy sheets being processed move together with transport means for moving said copy sheets along said paper path and at least one sheet supply tray having sheet feeder means for feeding fresh copy sheets into said paper path, the steps which comprise:

(a) actuating said sheet feeder means for a predetermined interval in response to the presence of a partially fed copy sheet at the outlet of said paper tray to move said partially fed sheet from said tray outlet into said paper path;

(b) starting said transport means to remove any copy sheets left in said paper path;

(c) scanning said paper path at predetermined locations along said paper path to detect any leftover copy sheets;

(d) on detecting a leftover copy sheet in said paper path at one of said locations, initiating a timed cycle for movement of said leftover copy sheet from said one location to the next second location;

(e) where said leftover copy sheet fails to reach said second location within said timed cycle, declaring a fault;

(f) where said leftover copy sheet reaches said second location within said timed cycle, instituting another timed cycle for movement of said leftover copy sheet from said second location to the next third location; and (g) repeating steps d and e until said paper path is cleared.

10. The process according to claim 9 including the step of: identifying to the operator the location of said partially fed sheet following timed actuation of said paper feeder means.

* * * * *